US010340624B2

(12) United States Patent
Schönfeld et al.

(10) Patent No.: US 10,340,624 B2
(45) Date of Patent: Jul. 2, 2019

(54) RETAINING FRAME

(71) Applicant: Harting Electric GmbH & Co. KG, Espelkamp (DE)

(72) Inventors: Alexander Schönfeld, Osnabrück (DE); Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/755,879

(22) PCT Filed: Sep. 2, 2016

(86) PCT No.: PCT/DE2016/100403
§ 371 (c)(1),
(2) Date: Feb. 27, 2018

(87) PCT Pub. No.: WO2017/036466
PCT Pub. Date: Mar. 9, 2017

(65) Prior Publication Data

US 2018/0248298 A1 Aug. 30, 2018

(30) Foreign Application Priority Data

Sep. 3, 2015 (DE) ..... 10 2015 114 700

(51) Int. Cl.
*H01R 35/00* (2006.01)
*H01R 13/518* (2006.01)

(52) U.S. Cl.
CPC ..... *H01R 13/518* (2013.01)

(58) Field of Classification Search
CPC .. H01R 13/518; H01R 13/506; H01R 13/514; H01R 13/193; H01R 9/2441
(Continued)

(56) References Cited

U.S. PATENT DOCUMENTS 3,160,280 A 12/1964 Burch
4,693,440 A 9/1987 Lalonde
(Continued)

FOREIGN PATENT DOCUMENTS

CN 201656162 U 11/2010
CN 202084755 U 12/2011
(Continued)

OTHER PUBLICATIONS

German Office Action, dated Jul. 28, 2016, for German Application No. 10 2015 114 700.9, 4 pages (no English translation provided).
(Continued)

*Primary Examiner* — Jean F Duverne
(74) *Attorney, Agent, or Firm* — Seed IP Law Group LLP

(57) ABSTRACT

Disclosed is a retaining frame for retaining plug connector modules and for installation in plug connector housings or for screwing onto wall surfaces, wherein the plug connector modules are inserted in the retaining frame, and retaining means on the plug connector modules interact with cut-outs or recesses provided on opposite wall parts (lateral parts) of the retaining frame. According to the disclosure, the retaining frame is designed in two halves connected to one another in an articulated manner and the cut-outs or recesses for retaining the plug connector modules are designed as openings in the lateral parts of the retaining frame. The retaining frame for inserting the plug connector modules is opened and subsequently closed, wherein the plug connector modules are held form-fittingly in the retaining frame via the retaining means on the plug connector modules.

12 Claims, 3 Drawing Sheets

(58) Field of Classification Search
USPC ..... 439/540.1
See application file for complete search history.

(56) References Cited

U.S. PATENT DOCUMENTS

| | | | | |
|---|---|---|---|---|
| 5,529,426 | A | 6/1996 | Masuda et al. | |
| 5,829,910 | A | 11/1998 | Kameyama | |
| 6,004,162 | A | 12/1999 | Harting et al. | |
| 6,196,869 | B1 * | 3/2001 | Kay | H01R 9/2441 439/532 |
| 6,350,141 | B1 * | 2/2002 | Houtz | H01R 13/193 439/341 |
| 6,692,310 | B2 | 2/2004 | Zaderej et al. | |
| 6,913,487 | B2 | 7/2005 | Beneke et al. | |
| 7,066,677 | B2 | 6/2006 | Rüter | |
| 7,753,701 | B2 | 7/2010 | Tsuji | |
| 7,896,694 | B2 | 3/2011 | Schumann et al. | |
| 8,292,676 | B2 * | 10/2012 | Schmidt | H01R 13/506 439/701 |
| 8,449,314 | B1 | 5/2013 | Feist et al. | |
| 8,668,530 | B2 | 3/2014 | Riepe et al. | |
| 8,821,186 | B2 | 9/2014 | Lan | |
| 8,979,568 | B2 | 3/2015 | Herbrechtsmeier et al. | |
| 9,502,813 | B2 | 11/2016 | Dugo | |
| 9,577,365 | B1 | 2/2017 | Herbrechtsmeier et al. | |
| 9,608,374 | B2 * | 3/2017 | Beischer | H01R 13/514 |
| 9,847,608 | B2 | 12/2017 | Bruex et al. | |
| 9,880,357 | B2 | 1/2018 | Drescher et al. | |
| 9,923,307 | B2 | 3/2018 | Beischer et al. | |
| 10,050,391 | B2 | 8/2018 | Herbrechtsmeier | |
| 2005/0070146 | A1 | 3/2005 | Lu | |
| 2006/0035501 | A1 | 2/2006 | Lewis et al. | |
| 2007/0155252 | A1 * | 7/2007 | Ferderer | H01R 13/506 439/680 |
| 2010/0159728 | A1 | 6/2010 | Wang et al. | |
| 2014/0179171 | A1 | 6/2014 | Mortun et al. | |
| 2018/0026405 | A1 | 1/2018 | Schlepp et al. | |
| 2018/0241149 | A1 | 8/2018 | Herbrechtsmeier et al. | |
| 2018/0248296 | A1 | 8/2018 | Herbrechtsmeier et al. | |
| 2018/0248297 | A1 | 8/2018 | Herbrechtsmeier et al. | |
| 2018/0254576 | A1 | 9/2018 | Herbrechtsmeier et al. | |
| 2018/0254577 | A1 | 9/2018 | Herbrechtsmeier et al. | |
| 2018/0254578 | A1 | 9/2018 | Herbrechtsmeier et al. | |
| 2018/0269621 | A1 | 9/2018 | Schönfeld | |
| 2018/0277978 | A1 | 9/2018 | Schönfeld et al. | |

FOREIGN PATENT DOCUMENTS

| | | | |
|---|---|---|---|
| CN | 202352910 | U | 7/2012 |
| CN | 202772345 | U | 3/2013 |
| CN | 104466562 | A | 3/2015 |
| CN | 204205152 | U | 3/2015 |
| CN | 204271392 | U | 4/2015 |
| DE | 197 07 120 | C1 | 6/1998 |
| DE | 197 45 384 | A1 | 4/1999 |
| DE | 20 2005 020 026 | U1 | 4/2006 |
| DE | 20 2012 103 360 | U1 | 3/2013 |
| DE | 20 2013 103 611 | U1 | 11/2013 |
| DE | 10 2013 106 279 | A1 | 12/2014 |
| DE | 10 2015 101 433 | B3 | 6/2016 |
| EP | 0 843 384 | A2 | 5/1998 |
| EP | 2 581 991 | A2 | 4/2013 |
| FR | 2 860 348 | A1 | 4/2005 |
| GB | 1 394 867 | A | 5/1975 |
| WO | 2014/155171 | A1 | 10/2014 |

OTHER PUBLICATIONS

International Search Report and Written Opinion, dated Nov. 21, 2016, for International Application No. PCT/DE2016/100403, 10 pages (with English translation of Search Report).

Harting Elektronik GmbH, "Schwere Steckverbinder Han-Modular®," Product Catalog, Jan. 1999, 44 pages.

International Preliminary Report on Patentability, dated Mar. 6, 2018, for International Application PCT/DE2016/100403, 14 pages. (with English Translation).

Written Opinion of the International Search Authority, dated Nov. 21, 2016, for International Application No. PCT/DE2016/100403, 6 pages. (English Translation).

Chinese Office Action, dated Dec. 5, 2018, for Chinese Application No. 201680047464.5, 6 pages.

* cited by examiner

RETAINING FRAME

BACKGROUND

Technical Field

This disclosure relates to a holding frame for holding plug-in connector modules.

Such holding frames serve to hold plug-in connector modules, wherein the holding frame is equipped with various plug-in connector modules and then inserted in a plug-in connector housing and screw-connected to the latter. The holding frame in this case must be mechanically stable in order to be able to withstand the insertion and withdrawal forces that occur as the plug-in connection is fitted together and disconnected.

Description of the Related Art

Known from the company document of the company HARTING Elektronik GmbH "Schwere Steckverbinder, Han-Modular , 16 3" is a substantially rectangular holding frame, which is provided with lateral walls extending at right angles to the mounting plane. The plug-in connector modules in this case are provided with latching hooks, which latch with the lateral walls when the plug-in connector modules are fitted into the holding frame and are thus fixedly held in the latter.

DE 197 07 120 C1 discloses a holding frame for holding plug-in connector modules and for mounting in plug-in connector housings or for screw-connection to wall surfaces, wherein the plug-in connector modules are inserted in the holding frame, and holding means on the plug-in connector modules act in combination with recesses provided on opposite wall parts (lateral parts) of the holding frame. The holding frame is composed of two halves that are hinge-connected to each other, and recesses, for holding the plug-in connector modules, are realized, as openings closed on all sides, in the lateral parts of the holding frame. In this case, for the purpose of inserting the plug-in connector modules, the holding frame is folded open and then closed, wherein the plug-in connector modules are then held in a form-fitting manner in the holding frame by means of the holding means.

In the case of the holding frame known from the prior art, it is disadvantageous that the plug-in connector modules that are inserted in the holding frame have a very large clearance. The modules are inserted in a very shaky manner in the frame, this originally being intended to provide for a greater tolerance compensation. In the present-day automated industrial environment, however, considerably higher tolerances are required. This is also due, not least, to automated plugging, i.e., contacting and decontacting of modular plug-in connectors.

BRIEF SUMMARY

Embodiments of the invention provide a holding frame, of the type stated at the outset, such that the accommodated plug-in connector modules are accommodated in the holding frame with as little clearance as possible. The tolerances in the deviation with respect to the position of the plug-in connector modules in the plug-in connector in this case are to be as small as possible. It is nevertheless to be ensured that the holding frame has a high mechanical stability, in order to withstand the insertion and withdrawal forces that occur as the plug-in connection is fitted together and disconnected.

The disclosure relates to a holding frame for holding plug-in connector modules. The holding frame in this case is designed for mounting in plug-in connector housings or for screw-connection to wall surfaces. The holding frame has opposing, elongate lateral parts, which have recesses that act in combination to accommodate plug-in connector modules.

The recesses are realized as openings in the lateral parts of the holding frame. The recesses in this case may be closed on all sides, or realized so as to be open, at least in regions. Plug-in connector modules to be inserted have corresponding holding means (e.g., projections, lugs) that can be accommodated in the openings. As a result of the holding means of the plug-in connector modules being accommodated in the openings of the lateral parts, the plug-in connector modules are held between the lateral parts.

According to an embodiment of the invention, the recesses do not extend uniformly through the lateral parts of the holding frame. On the side of a lateral part that respectively faces away from the opposite lateral part, the recesses are realized so as to be expediently smaller than on the side of the lateral part that respectively faces toward the opposite lateral part. The recesses thus taper from the interior of the holding frame to the exterior of the holding frame.

A particularly advantageous embodiment provides that the recesses realized on the interior of the holding frame are rectangular. In two mutually adjacent corner regions of the recesses, the corners converge toward the exterior. On the exterior, the two corner regions thus respectively form two corners. A triangular surface, which realizes the taper of the recess, is thus formed between these two corners and the associated corner, on the interior of the lateral part.

In a particularly advantageous embodiment, the holding frame is composed of two halves that are hinge-connected to each other by hinge joints. The halves can be tilted toward each other by the hinge joints. Tilting of the two halves causes the lateral parts of the holding frame to open, such that plug-in connector modules can be inserted.

To enable the holding means (e.g., projections, lugs) to be seated in the recesses in a form-fitting, firm manner, the holding means of the plug-in connector modules are realized to correspond to the recesses. The holding means in this case form respectively the negative form of the recess. In other words, the holding means have the inverse shape of the recesses. Thus, by way of the oblique surfaces in the recesses, a fit is produced for the plug-in connector modules in the holding frame.

A particularly advantageous embodiment provides that the holding means (e.g., projections, lugs) and the recesses are realized such that, when the plug-in connector modules are inserted in the holding frame, a press fit, of the modules in the frame, is produced. The plug-in connector modules are thereby additionally held in the holding frame in a force-fitting manner.

Advantages achieved by embodiments of the present invention include, in particular, in that inserted plug-in connector modules are held in a form-fitting manner between the lateral parts of the holding frame and, depending on the design of the holding frame, at the same time also render possible a slight force-fit, for fixing the plug-in connector modules. Thus, it is only with great difficulty that the plug-in connector modules can be moved in the holding frame. A further advantage consists in that, after the holding frame has been fitted into a plug-in connector housing, the plug-in connector modules are fastened in a form-fitting manner in the holding frame, and thus overall there is a high mechanical stability for absorbing or transferring the insertion and withdrawal forces of the plug-in connection.

BRIEF DESCRIPTION OF THE SEVERAL VIEWS OF THE DRAWINGS

An exemplary embodiment of the disclosure is represented in the drawings and explained in greater detail in the following. In the drawings.

The figures are in part simplified, schematic representations. In some cases identical references are used for elements that are alike, but possibly not identical. Differing views of the same elements may differ in scale.

DETAILED DESCRIPTION

Figure 1:
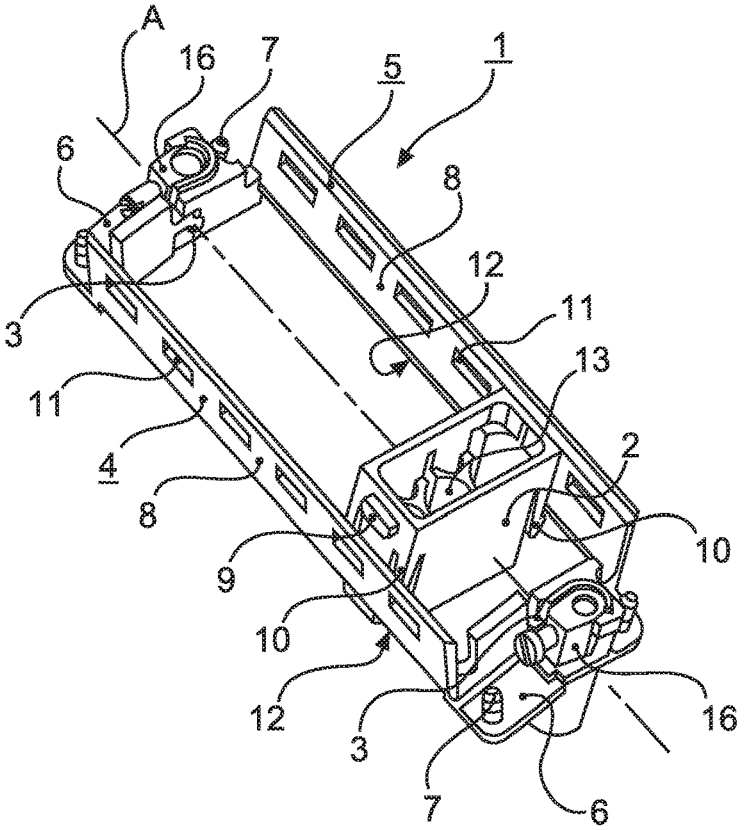
FIG. 1 shows a view of an opened holding frame.
Figure 2:
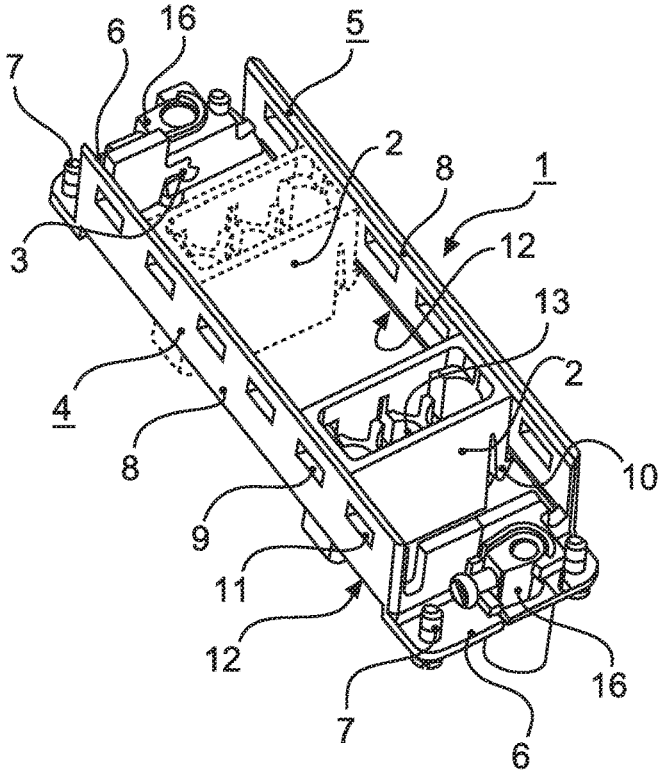
FIG. 2 shows a view of a closed holding frame.

Represented in FIGS. 1 and 2 is a holding frame 1 for plug-in connector modules 2, wherein in FIG. 1 the holding frame is open, and is closed in FIG. 2. The holding frame 1 is designed, following the fitting of plug-in connector modules, to be mounted in plug-in connector housings (for which, see FIG. 4) or to be fastened, via an opening, to a fastening surface/mounting wall.

The holding frame 1 is composed of two halves 4, 5, connected via hinge joints 3, having fastening ends 6, which are provided with fastening screws 7. The hinge joints in this case are provided at the fastening ends 6 of the holding frame 1, wherein the pivot capability of the frame halves 4, 5 is provided transversely to the lateral parts 8 of the holding frame 1. Shaped elements, which engage in corresponding recesses, are respectively provided at the fastening ends 6 of the holding frame, or of the lateral parts, to form the hinge joints 3. These shaped elements in this case are inserted into the recesses by lateral displacement of the lateral parts, wherein the lateral parts can then be pivoted (rotated) about the longitudinal axis A.

After the lateral parts 8 are joined together, delimitation studs 16, realized here as grounding contacts, are fitted into the fastening ends, wherein the delimitation studs are each provided at the outer ends of the lateral parts 8, and the hinge joints 3 are thus located between the delimitation studs 16. This arrangement of the delimitation studs 16 prevents axial displacement of the lateral parts 8.

The plug-in connector modules are provided with projecting, approximately rectangular holding means 9 (e.g., projections, lugs) and elastic latching hooks 10. Provided in the lateral parts 8 of the frame halves 4, 5 there are recesses 11, realized as openings that are closed on all sides, into which the holding means 9 go when the plug-in connector modules 2 are fitted into the holding frame 1.

For the purpose of fitting the plug-in connector modules 2, the holding frame 1 is folded open, i.e., opened, wherein the frame halves 4, 5 are folded open about the hinge joints 3 to such an extent that the plug-in connector modules 2 can be inserted. For the purpose of pre-fixing the plug-in connector modules 2, during fitting the latching hooks 10 first engage beneath the lower edges 12 of the lateral parts 8 of the frame halves 4, 5.

The frame halves 4, 5 are then folded together, i.e., the holding frame is closed, wherein the holding means 9 go into the recesses 11, causing the plug-in connector modules 2 to be held in the holding frame 1 in a secure, form-fitting manner.

Figure 3:
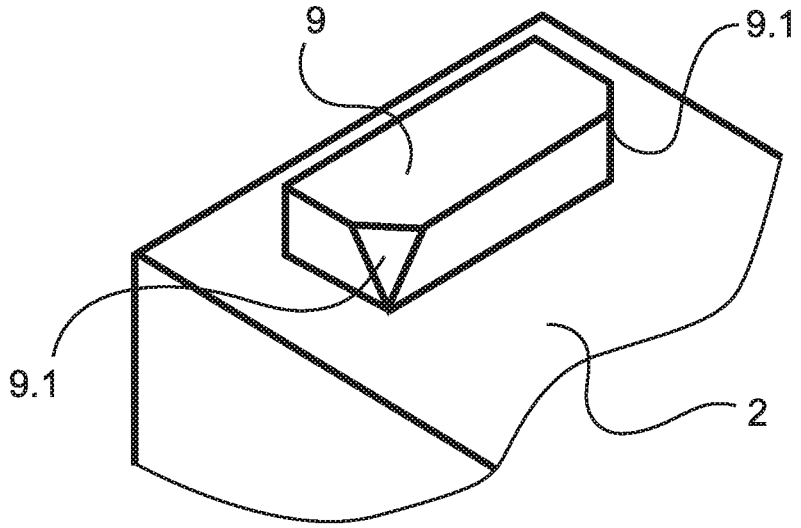
FIG. 3 shows a detail view of a holding means of a plug-in connector module.

A detail view of a holding means 9 on a plug-in connector module 2 is represented in FIG. 3. According to an embodiment of the invention, the holding means 9 is realized substantially as a rectangular parallelepiped, and formed on the plug-in connector module 2. Two mutually adjacent corner regions of the holding means 9 are beveled and in each case form a triangular surface 9.1.

The purpose of the beveled corner regions of the holding means 9 is that, according to an embodiment of the invention, the lower surface of the holding means 9 here is larger than the upper surface of the holding means 9.

Figure 4:
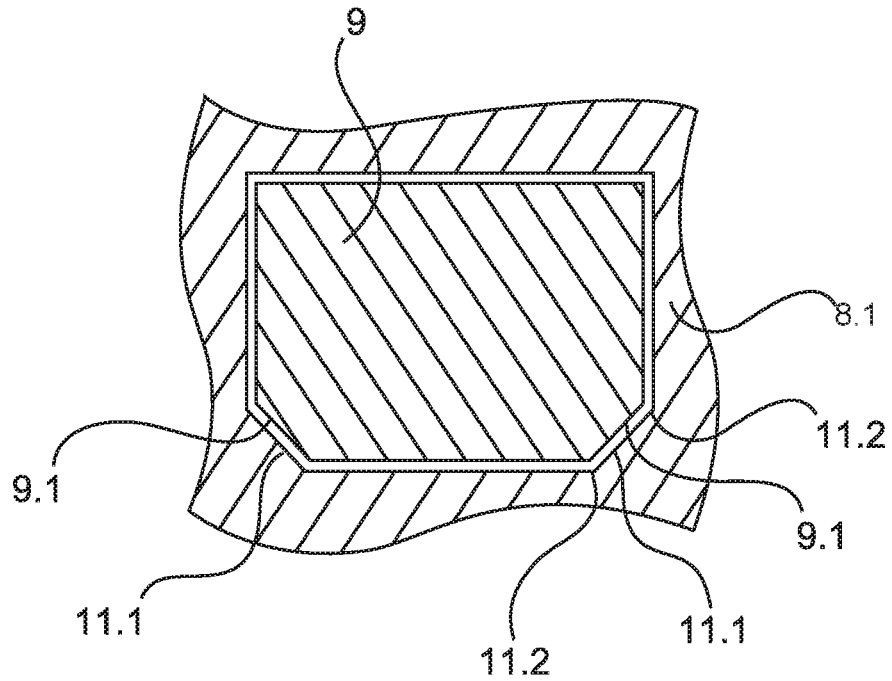
FIG. 4 shows a sectional representation of a recess with a holding means received therein.

FIG. 4 shows a sectional representation through a recess 11 with a holding means 9 accommodated therein. In this case, the section of the representation is located in the outer region of the lateral part 8. The figure shows the corner regions in the lower region of the recess 11, which are beveled. The gap that can be seen between the recess 11 and the holding means 9 is only to aid illustration and, according to an embodiment of the invention, exists only to a minimal extent or is not present.

Figure 5:
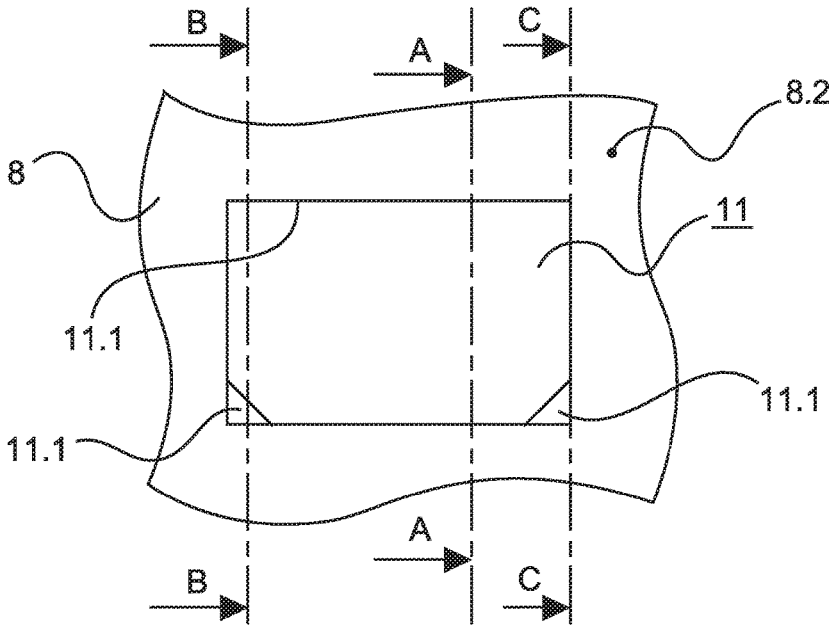
FIG. 5 shows a detail view of a recess of a lateral part of the holding frame.
Figure 6:
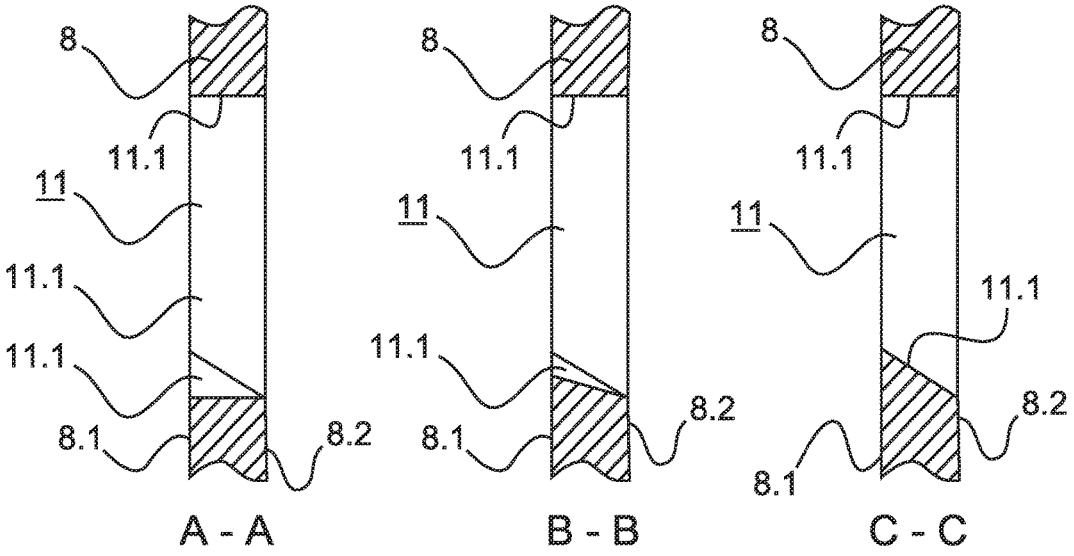
FIG. 6 shows three sectional representations of the recess from FIG. 5.

To aid illustration, a recess 11 according to an embodiment of the invention is shown yet again in FIGS. 5 and 6. In this case, the recess 11 is shown in FIG. 5 as viewed toward the interior of the lateral part 8. The recess 11 is surrounded by six delimiting surfaces 11.1. Two triangular surfaces can be seen in the lower region of the rectangular recess 11. The triangular surfaces are part of the surfaces 11.1 delimiting the recess 11, and are provided to correspond to the triangular surfaces 9.1 of the holding means 9 of the plug-in connector module 2.

The recess 11 of FIG. 5 is illustrated in greater detail, in three sectional representations, in FIG. 6. The lateral part 8 in this case has a first side 8.1, which is oriented inward and assigned to an inserted plug-in connector module 2. And a second side 8.2, which is disposed on the exterior of the holding frame 1.

In this case, the section A-A is located in the central region of the recess 11. Fully visible at the bottom of the section is the triangular surface, which is a part of the surfaces 11.1 delimiting the recess 11. The section B-B is located centrally through one of the triangular surfaces. Also visible, in the lower region of the section B-B, is the complete triangular surface located behind. The section C-C is located in the outermost region of the recess 11, as a result of which, in the view C-C, the corner region has the tapering form according to an embodiment of the invention. The delimiting surface 11.1 shown at the bottom is in this case disposed at an angle of approximately 45 degrees in relation to the first side 8.1 and the second side 8.2.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame for holding plug-in connector modules and for mounting in plug-in connector housings or for screw-connection to wall surfaces, the holding frame comprising:

opposing lateral parts, wherein the lateral parts each have an inner sidewall surface facing toward the opposite lateral part, an outer sidewall surface facing away from the opposite lateral part, and at least one opening extending completely through the lateral part from the inner sidewall surface to the outer sidewall surface, and wherein an area bound by an outer profile of the opening at the outer sidewall surface is smaller than an area bound by an outer profile of the opening at the inner sidewall surface.

2. The holding frame as claimed in claim 1, wherein the opening is defined by at least one surface that extends between the outer sidewall surface and the inner sidewall surface.

3. The holding frame as claimed in claim 2, wherein the opening is defined by a plurality of surfaces that extend between the outer sidewall surface and the inner sidewall surface, and wherein at least one of the plurality of surfaces that extends between the outer sidewall surface and the inner sidewall surface is oriented at an angle other than 90 degrees in relation to the outer sidewall surface and the inner sidewall surface.

4. The holding frame as claimed in claim 3, wherein the opening is defined by three surfaces that extend between the outer sidewall surface and the inner sidewall surface, wherein one of the surfaces is oriented at an angle other than 90 degrees in relation to the outer sidewall surface and the inner sidewall surface, and wherein two surfaces are oriented at an angle equal to 90 degrees in relation to the outer sidewall surface and the inner sidewall surface.

5. The holding frame as claimed in claim 3, wherein the opening is defined by four surfaces that extend between the outer sidewall surface and the inner sidewall surface, wherein one of the surfaces is oriented at an angle other than 90 degrees in relation to the outer sidewall surface and the inner sidewall surface, and wherein three surfaces are oriented at an angle equal to 90 degrees in relation to the outer sidewall surface and the inner sidewall surface.

6. The holding frame as claimed in claim 3, wherein the opening is defined by five surfaces that extend between the outer sidewall surface and the inner sidewall surface, wherein two of the surfaces are oriented at an angle other than 90 degrees in relation to the outer sidewall surface and the inner sidewall surface, and wherein three surfaces are oriented at an angle equal to 90 degrees in relation to the outer sidewall surface and the inner sidewall surface.

7. The holding frame as claimed in claim 1, wherein the openings have a substantially rectangular shape.

8. The holding frame as claimed in claim 1, wherein the openings have a substantially triangular form.

9. The holding frame as claimed in claim 1, wherein the holding frame is composed of two halves that are hinge-connected to each other, and that each have the lateral part and are connected by two hinge joints.

10. The holding frame as claimed in claim 1, wherein, for each lateral part, a cross-sectional area of the opening gradually increases with increasing distance away from the outer sidewall surface toward the inner sidewall surface.

11. The holding frame as claimed in claim 1, wherein, for each lateral part, the outer profile of the opening at the outer sidewall surface is a hexagon and the outer profile of the opening at the inner sidewall surface is a tetragon.

12. A holding frame for holding plug-in connector modules having laterally extending lugs, the holding frame comprising:

opposing lateral parts, wherein the lateral parts each have an inner sidewall surface facing toward the opposite lateral part, an outer sidewall surface facing away from the opposite lateral part, and at least one opening extending completely through the lateral part from the inner sidewall surface to the outer sidewall surface to receive a respective one of the lugs of the plug-in connector modules, and wherein an area bound by an outer profile of the opening at the outer sidewall surface is smaller than an area bound by an outer profile of the opening at the inner sidewall surface.

* * * * *